US006369510B1

(12) United States Patent
Shaw et al.

(10) Patent No.: US 6,369,510 B1
(45) Date of Patent: Apr. 9, 2002

(54) BLUE TINTED AUTOMOBILE LAMP CAPSULE

(75) Inventors: Cathy M. Shaw, Manchester, MA (US); Susan L. Callahan, Peterborough; Paul A. Young, Merrimack, both of NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/482,706

(22) Filed: Jan. 13, 2000

(51) Int. Cl.[7] ..... H01J 17/16

(52) U.S. Cl. ..... 313/635; 313/112

(58) Field of Search ..... 313/635, 493, 313/489, 112

(56) References Cited

U.S. PATENT DOCUMENTS 4,965,485 A * 10/1990 Tarumi et al. ..... 313/112

* cited by examiner

*Primary Examiner*—Vip Patel
(74) *Attorney, Agent, or Firm*—William E. Meyer

(57) ABSTRACT

The invention involves application of a luster coating to the exterior of a glass lamp capsule envelope to obtain a blue coloration of the transmitted light. The result is a higher color temperature light source that is commercially preferred. The preferred blue luster is formed from a coating solution containing organometallic components and solvent, that is heat treated in an oxidizing atmosphere to form a gold containing bismuth-titanium oxide material. The filament is adjusted to yield the overall necessary number of lumens. The blue luster tinted automobile lamp capsule is a durable, and yields the proper number of lumens with little or no increase in glare. The blue luster tinted lamp capsule is therefore compliant with legal standards.

18 Claims, 5 Drawing Sheets

BLUE TINTED AUTOMOBILE LAMP CAPSULE

TECHNICAL FIELD

The invention relates to electric lamps and particularly to automotive lamp capsules. More particularly the invention is concerned with blue tinted automotive lamp capsules.

BACKGROUND ART

With the advent of HID headlights, there has been a commercial demand for halogen lamps that provide bluer (less yellow) road lighting. The bluer light is believed to give better color perception, and may light up road marks and signs better. As a result there have been a variety of attempts to color tungsten halogen lamps without excessively reconstructing the existing lamp production lines. One method is to coat the exterior of the lamp with an interference coating. The interference layers filter the light, producing a bluer spectrum. The interference layers need to be coated accurately (about a quarter of a wave length), and numerous layers need to be built up to form an effective filter. The accurate industrial processing of such stack systems on a curved lamp capsule bulb is difficult to achieve, and only in rather slow or else inaccurate processes. None the less, lamps have been made, but the results have not been satisfactory. Interference layer coated lamp capsules are generally found to be non-compliant with existing legal standards. There is usually excessive glare as light is reflected or refracted from the various layers. Such lamp capsules tend to dazzle or glitter as a result. The interference layers also tend to cause color separation in the beam, so that as one views a beam from different angles one sees different colors. This makes viewing the illuminated roadway difficult, and is considered distracting to other drivers. The applicants have tested interference coated bulbs, and none have passed the glare requirements set forth by the SAE and the U.S. standard in F.M.V.S.S. section 108.

Alternatively, lamp capsules may be coated with colored resins. Although the filament produces an integrated color within the required SAE white region, the resin coated lamp capsules may still have a color separation. There are regions of non-compliant colored light emanating from the system particularly at the edges of the beam. Headlamp bulbs have relatively hot surfaces, running at temperatures up to 650 degrees Celsius. The existing resin dipped lamp capsules have generally been found to have limited life. The resin material on the hot lamp capsule glass, ages rapidly and fades, crazes, flakes, or peals off. The result is at best a lamp capsule that is no longer blue, and at worst a lamp capsule that has streaks or patches of blue and yellow light. Since the lamp capsule must produce additional lumens to account for the lumens that are filtered out, the lamp capsules are designed with higher initial lumen outputs. When the resin material flakes off, the lamp capsule can then be out of specification, emitting excessive light. In a similar fashion, light may be refracted or reflected from exposed portions of the failing resin coating, resulting in irregular lighting and glare.

Another alternative is to color the glass itself. Blue colored glass can be prepared using several different colorants. The colorant can be added to the glass composition. The precise color of the glass, or coating, depends on the oxidation state of the colorant and the matrix composition (i.e. ligand field effect). Weyl (Weyl, W. A., Coloured Glasses, Dawson's of Pall Mall London, 1959), and Bamford (Bamford, C. R., Glass Science and Technology 2, Colour Generation and Control in Glass, Elsevier Scientific Publishing Co, NY 1977) reviewed the use of various compounds that contain chromium, cobalt, copper, iron, nickel, titanium and vanadium, to produce a blue color in glass. At this time, consumer demand for tinted headlamps is not so great that the manufacture of blue tubing stock is justified. Nor is the devotion of a complete lamp capsule production line to blue tinted lamp capsules justified.

In one alternative, Corning Inc. disclosed a method of converting clear tube stock to blue tinted stock (Blue High Silica Glass U.S. Pat. No. 5,610,107 issued Mar. 11, 1997). The Corning invention involves impregnating a porous high silica glass with a solution containing cobalt and other components, then re-consolidating the glass under oxidizing conditions to produce blue glass. While the Corning invention produces blue colored glass, the method of obtaining it is time consuming and requires shifting a lamp capsule production machine to run according to the new glass's characteristics. It is also unlikely that the impregnation process could be used to color already finished lamp capsules.

There is then a need for method to color coat complex shaped glass objects, such as a finished headlamp capsule. The coating processing must be compatible with the existing capsule construction process. For example, any firing of the coating must be at or below the glass transition temperature of the glass substrate. There is also a need for a lamp capsule coating wherein the coating adheres or is bonded to the glass surface during normal operation of the lamp capsule. There is a need for a coating that can withstand elevated temperatures without degrading optically (fading or changing color) or physically (peeling, crazing, or flaking). There is a need for a coating that is sufficiently durable that it can mechanically withstand ordinary handling. There is a need for a coated lamp capsule in combination with existing headlamp reflectors that meets SAE and legal specifications for glare, color, total lumens, and light distribution.

DISCLOSURE OF THE INVENTION

A blue tinted automobile lamp capsule including a glass envelope; and a tungsten halogen light source enclosed in the envelope; may be durably coated with a blue tinted luster including gold, titanium oxide and bismuth oxide to form a thin surface skin on the exterior of the envelop. The resulting coated lamp provides a headlamp beam with improved night vision characteristics.

BEST MODE FOR CARRYING OUT THE INVENTION

A blue tinted automotive lamp capsule may be formed with a thin luster coating applied to the exterior lamp capsule glass to obtain a blue shift in transmitted light color. The coating is based on a gold containing bismuth-titanium oxide material, which produces a blue coloration. Blue coloration has been observed for certain ceramic materials when Ti3+ is present. The blue color of the coating may be attributed to the presence of reduced titanium oxide in the coating.

Figure 1:
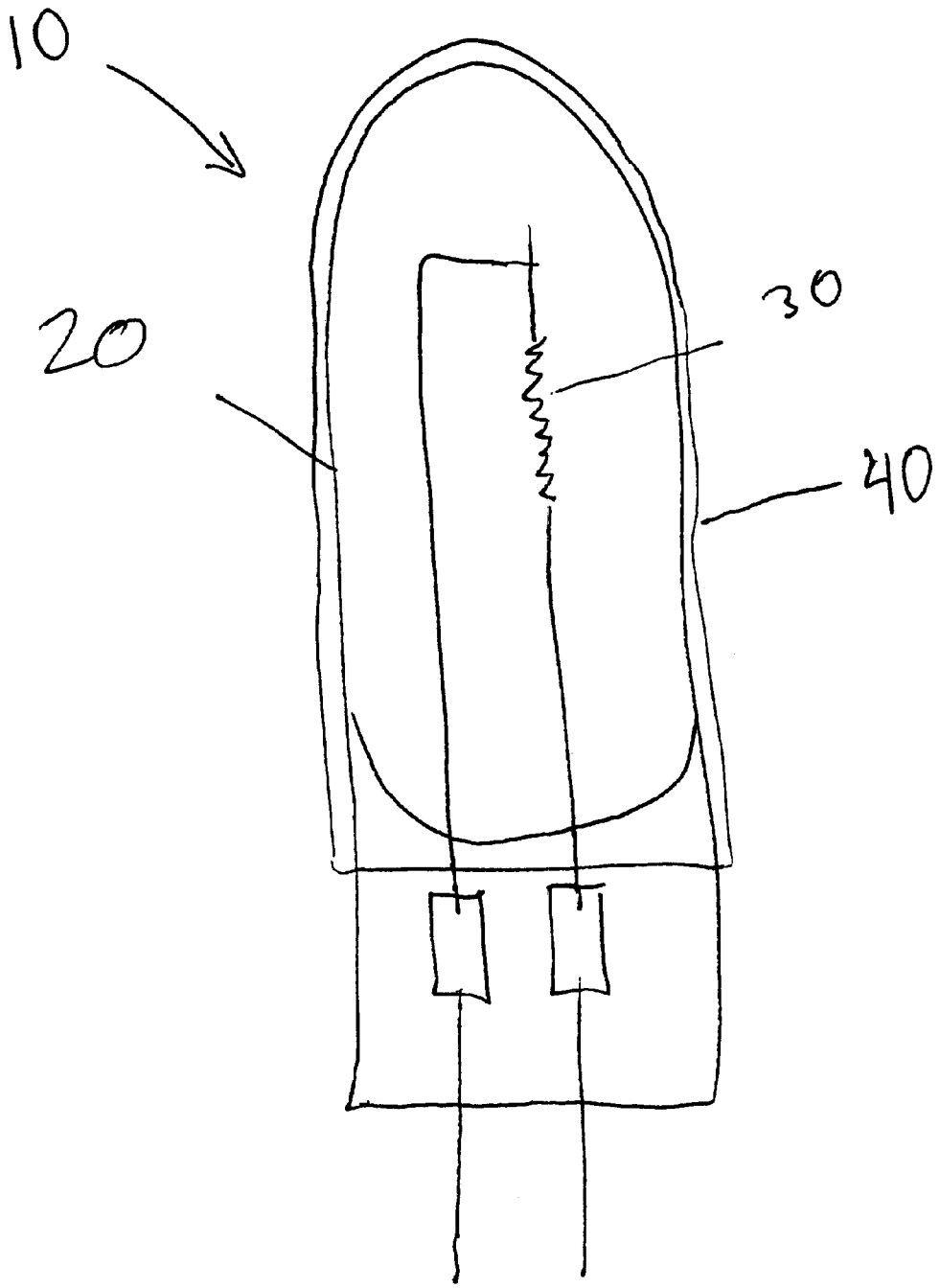
FIG. 1 shows a perspective view of a preferred embodiment of a blue tinted vehicle lamp capsule.
Figure 2:
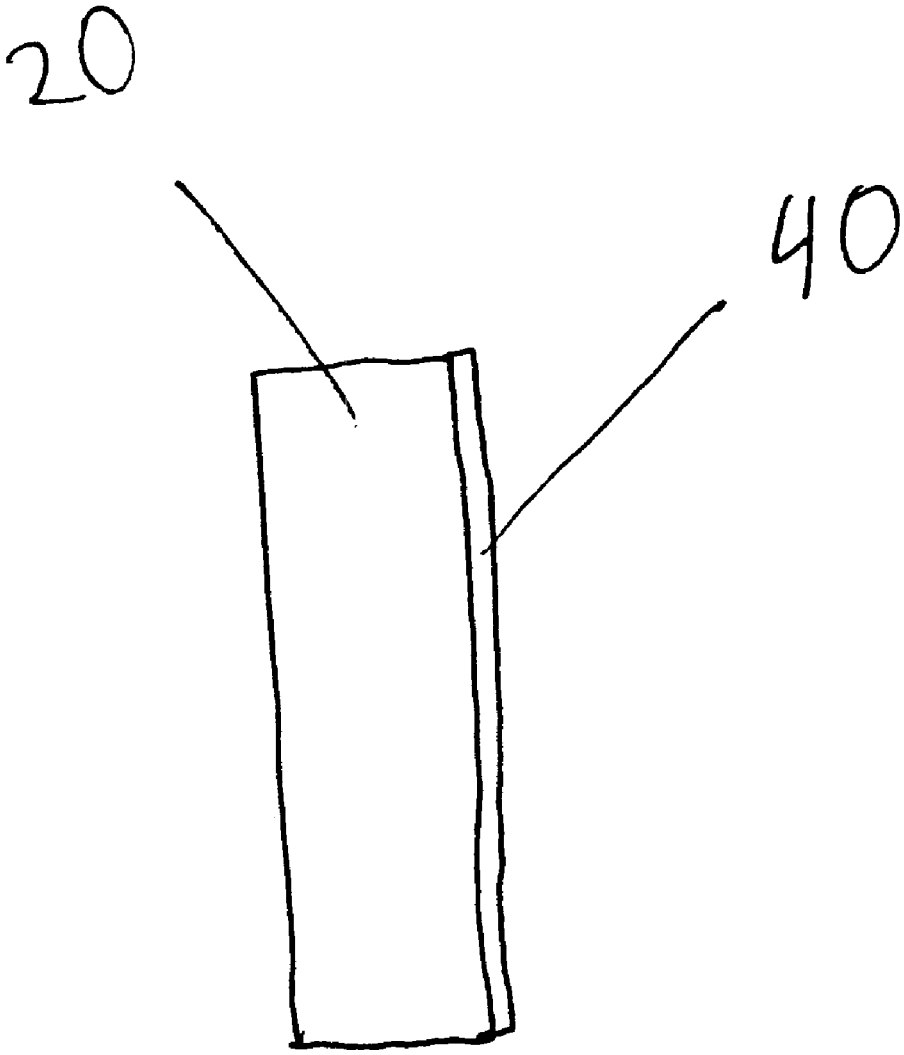
FIG. 2 shows a cross sectional view of a section of a glass envelope with a blue tinted luster coating.

FIG. 1 shows a perspective view of preferred embodiment of a blue tinted automobile lamp capsule 10. Like reference numbers designate like or corresponding parts throughout the drawings and specification. The blue tinted automobile lamp capsule 10 is assembled from a glass envelope 20, a tungsten halogen light source 30, and a thin coat of a blue tinted luster 40. FIG. 2 shows cross sectional view of a section of a portion of a glass envelope 20. The glass envelope 20 may be made out of aluminosilicate glass or quartz to have the general form of a tube with closed ends. Other forms are possible as is known in the art. The glass envelope 20 encloses the tungsten halogen light source 30. The tungsten halogen light source 30 may be made with a tungsten filament surrounded by a halogen fill as is known in the art. Formed on the exterior of the lamp envelope 20 is the blue tinted luster 40.

The blue tinted luster 40 is formed in general by dipping the lamp capsule in the coating solution and then heat treating the coating in a furnace to obtain the desired properties; that is the conversion of the coating solution to a gold and bismuth-titanium oxide material that adheres to the exterior of the envelope. The first step is to form a glass envelope 20 enclosing a tungsten halogen lamp system. Numerous tungsten halogen lamp capsule manufacturing methods are known. The coated lamp capsule 10 requires a significant increase in the number of clear capsule lumens to overcome the absorption effect of the coating. The light source 30 (coil) is therefore designed to provide a significantly higher number of lumens. In the Applicants' design, the clear bulb lumens were increased by about 50 percent to account for the lumen loss. Unfortunately, the increase in luminous efficacy necessarily results in a decrease in filament life.

Next an adequate coating material is formed. In one embodiment, the coating solution for the blue tinted luster 40 may be composed of a mixture of gold, titanium and bismuth organometallic compounds and solvents. When the coating is heated in the furnace the organic components of the coating are decomposed, and a gold containing bismuth-titanium oxide material is formed. X-ray diffraction analysis of the coating reveals gold and bismuth-titanium oxide (Au and Bi2Ti2O7) phases.

In the preferred embodiment the organometallic titanium compound is identified by its C.A.S. number 5593-70-4. The C.A.S. registry gives the following information for the material: Titanic acid, tetrabutyl ester; RTC 99-03 XV3038000; NDN 145-0259-2402-0; MOLECULAR FORMULA C16-H36-O4. Ti; RTECS NUMBER XR1585000; MOLECULAR WEIGHT 340.42; WISWESSER LINE 40-TI-04&04&04; (SYNONYMS 1-Butanol, titanium(4+) salt (9CI); Butyl alcohol, titanium(4+) salt (8CI); Butyl orthotitanate; Butyl titanate; Orgatics TA 25; Tetrabutoxytitanium; Tetrabutyltitanate; Titanium butoxide (Ti(OBu)4); Titanium tetrabutoxide; Titanium tetrabutylate; Titanium tetrakis(butoxide); Tyzor TBT). This is mixed with an organometallic bismuth compound and diluted with a solvent. Various organometallic bismuth compounds (such as bismuth acetate, bismuth 2-ethylhexanoate, bismuth t-pentoxide, and bismuth titanium isopropoxide) are commercially available (e.g. Alfa Aesar). Other materials, such as gold compounds, may be added to the coating solution to alter the coating appearance. It is estimated that gold compounds, such as hydrogen tetrachloroaurate (III), may be used in the coating solution. The preferred solvent for the coating solution is toluene. Heat treatment of the coating in an oxidizing atmosphere results in the formation of a gold and bismuth-titanium oxide material.

A commercially available product (available from Englehard Hanovia as Luster Dark Blue 130F (catalog number 40-8528)) has been used to produce the desired color and coating properties. The intensity of the blue color depends in part on the dilution of the blue luster coating material, the dip-coating speed, and the firing temperature. An oxidizing atmosphere is believed to be necessary to remove the organic portions of the organometallic coating mixture. When the blue luster coating material is diluted with toluene, blue coatings with differing intensities can be obtained. The blue color is attributed to a broad absorption band in the red (550 to 650 nanometer) region of the visible spectrum. The intensity of the absorption band increases as the volume percent of blue luster coating material in the coating solution increases. The Applicants' preferred coating is from 48 percent to 56 percent luster coating material with the remainder being the solvent. The degree of dilution of the luster coating material, and the dip-coating parameters are balanced to obtain the desired blue coloration, which is directly related to the coating thickness. Therefore, the degree of dilution is relevant to proper processing of the lamps; a low dilution with toluene results in dark, non-uniform blue coloration, while a high dilution with toluene results in an ineffectively thin coating.

The third step is to coat the lamp capsule with the blue luster and solvent solution. The coating is easily applied using a dip-coating process; other coating techniques such as spray coating can also be used to apply the coating. The coating thickness and uniformity may be controlled by the speed of the dip coat and the luster content of the coating solution. The Applicants used a dip coat speed of approximately 1.5 to 2.0 centimeters per second. Changes in the coating thickness can be made to adjust the color intensity. The coating should preferably take place in a saturated vapor layer to achieve a uniform layer. It is clear that multiple coats of a more dilute material or a thinner coating of a more concentrated material may be used. The preferred application results in a layer about 75 to 100 nanometers thick of a gold containing bismuth-titanium oxide material. The preferred coating 40 includes gold, titanium oxide, and bismuth oxide. The preferred molar ratio of titanium oxide to bismuth oxide is from 1/1 to 1/1.5. The preferred gold content is from 4 to 8 atomic percent. It should be understood that there is tradeoff between how thick to make the luster layer 40, versus how much to increase the filament output. It is up to the designer to select how much of an increase in blue is desired, and therefore how much of an offsetting increase in the clear lamp capsule lumens is needed.

The fourth step is to heat the solution coated lamp capsule to a sufficient temperature to convert the solution coating to a gold and bismuth-titanium oxide material that adheres to the lamp capsule and produces a durable, transparent blue tinted automotive lamp capsule. The Applicants have found that the color intensity may be altered slightly by firing the coating at different temperatures. Increased firing time results in a slightly deeper blue. Similarly, a slightly higher temperature results in a somewhat bluer coating. While a deeper blue coating is generally desirable, since a thinner coating can then be used to achieve the same results, a higher firing temperature may lead to greater oxidation of the lamp lead wires which may be a problem for some electrical coupling procedures. The preferred firing is to ramp up from ambient to the hold temperature at a rate of about 15 degrees Celsius per minute. The coated lamp capsule is then held at the firing temperature for a period preferably from 4 to 6 minutes. The preferred firing temperature range is from 525 degrees Celsius to 675 degrees Celsius, with a preferred firing temperature of 650 degrees Celsius. The upper temperature limit is set by the material limitations of the glass substrate, and the desire to limit oxidation of the lead wires. The coated lamp capsule is then cooled to 500 degrees Celsius in the furnace, or ramped down to ambient temperature at a rate of 15 degrees Celsius per minute. The coated and fired lamp capsule 10 is then assembled into a base and electrically connected in the ordinary way as would normally be done for a clear lamp capsule.

In a working example some of the dimensions were approximately as follows: The blue luster material was used to apply luster coatings to 9004, 9005, 9006, and 9007 lamp capsules as well as a variety of sealed beam capsules. The standard size glass envelopes were made of aluminosilicate glass, (Corning 1724). The blue tinted luster was composed of a gold containing bismuth-titanium oxide material, and had an applied thickness of about 75 to 100 nanometers.

Several blue luster coatings were prepared on 9004 capsules, with various toluene dilution factors, to produce coatings with different blue intensities. The 9004 lamp capsule has an aluminosilicate glass envelope, (Corning 1724) and is normally operated with a surface temperature in the range of 300 degrees Celsius to 650 degrees Celsius. The coatings were obtained by dip coating the 9004 lamp capsules. The solution coated samples were fired in air at two different temperatures to evaluate the color generation; the furnace temperatures were approximately 1) 545° C. and 2) 670° C. The samples fired at 545° C. showed a blue-gray appearance, while the samples fired at 670° C. displayed a more intense blue coloration.

The coating solution produced a deep blue luster coating on glass. When the blue luster coating solution is diluted with toluene, blue coatings with various intensities can be obtained. In addition, the color can be altered slightly by firing the coating at different temperatures. Several blue luster coatings were prepared with various toluene dilution factors, which produce coatings with different blue intensities. The color of the coatings ranged from deep blue to a light violet.

Figure 3:
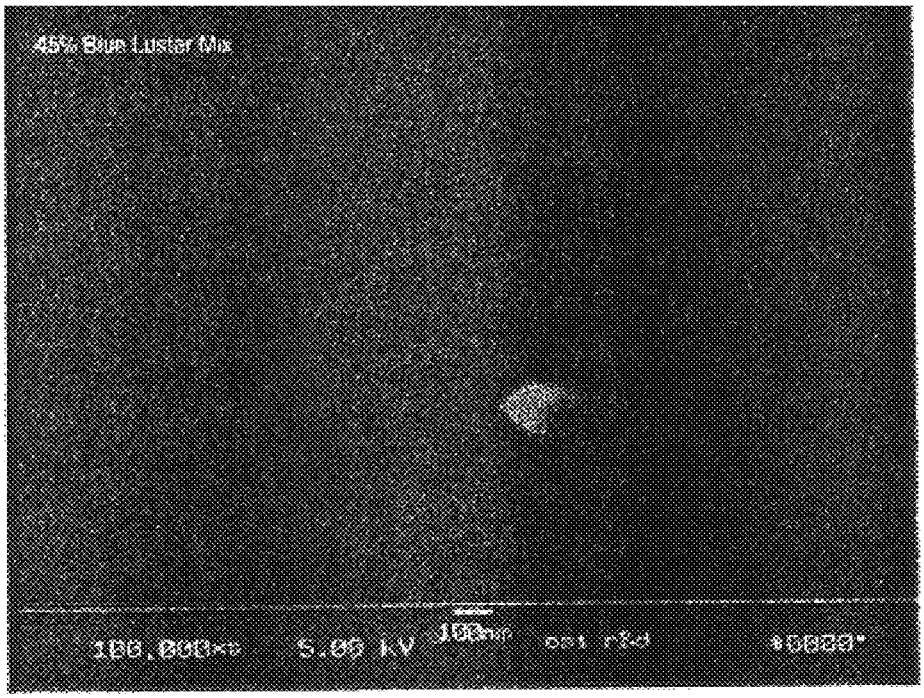
FIG. 3 shows a field emission scanning electron microscope (FESEM) image of the surface microstructure of the blue coating.
Figure 4:
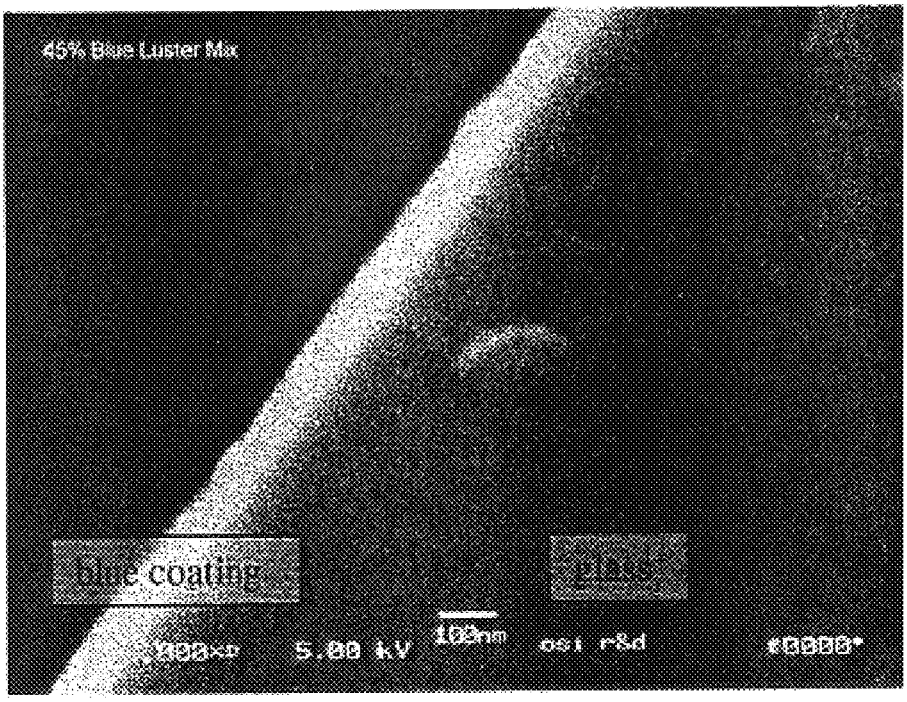
FIG. 4 shows a field emission scanning electron microscope FESEM image of the cross-section of the blue coating.

The coatings were tested by dip coating the lamp capsules and SiO2 glass slides. The coated samples were fired in air at three different temperatures to evaluate the color generation; the furnace setpoint temperatures were 1) 500° C., 2) 575° C. and 3) 650° C. Samples fired at 500 and 575° C. showed a blue-gray appearance, while the samples fired at 650° C. displayed a more intense blue coloration. The color change for the samples fired at 650° C. can be attributed to a change in the shape of the absorption band centered at approximately 600 nanometers. The coated samples were fired in air to the specified temperature ranging from 500–700° Celsius. The resulting coating surface was homogeneous and featureless at 50,000 times magnification. This transparent nature of the coating is very important for automotive applications, where the absence of scattering centers in the coating is essential. The resulting coating surface was uniform, with a coating thickness of approximately 75 to 100 nanometers. FIG. 3 shows a FESEM image of the surface micro structure of the blue coating. FIG. 4 shows a FESEM image of the cross-section of the blue coating.

Figure 5:
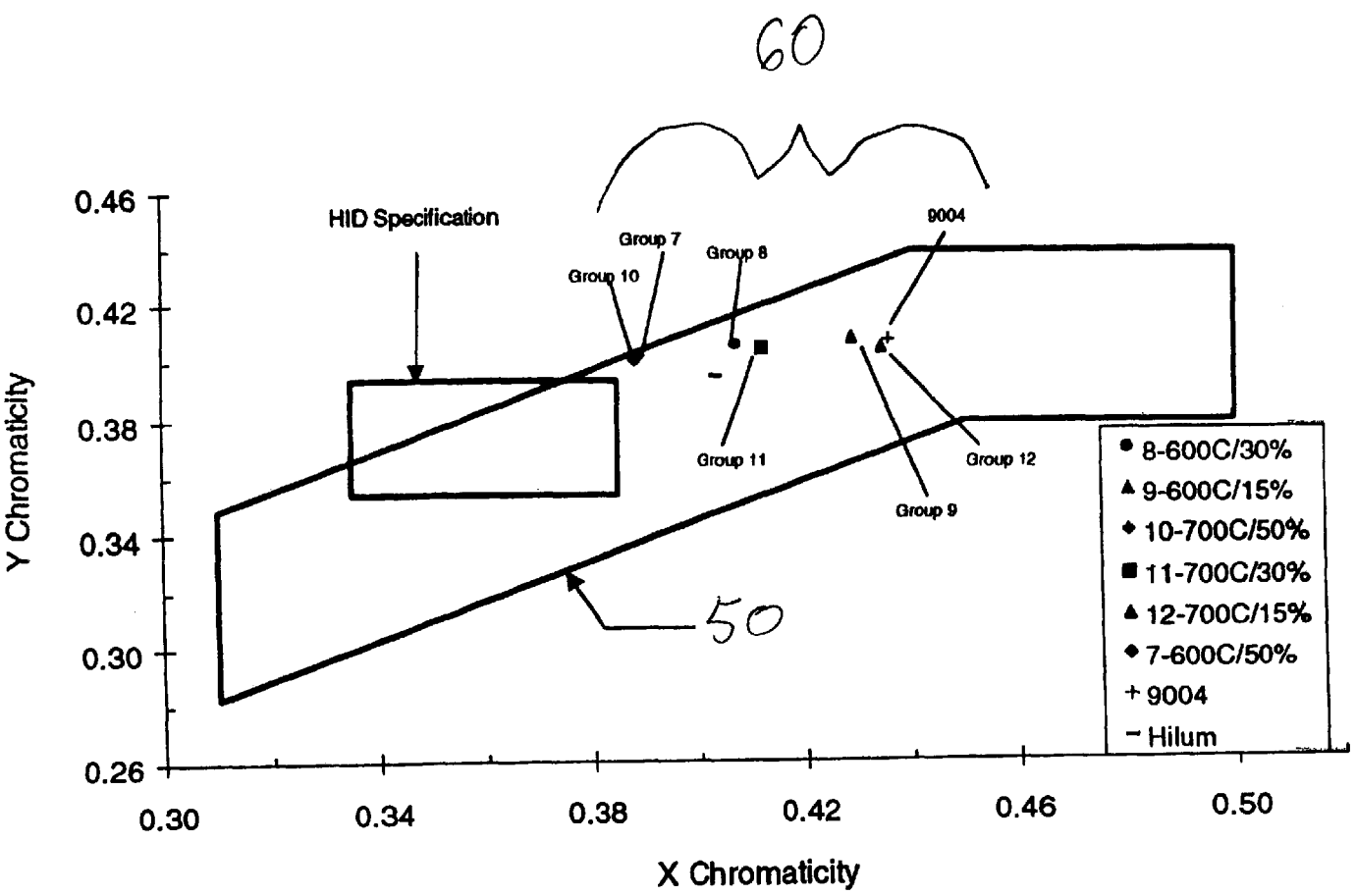
FIG. 5 charts the SAE defined white region, and data points from lamp samples.

The blue luster solution produced a deep blue coating on the glass. Chromaticity measurements were made on a variety of blue coated 9004 capsules. The blue coloration of the 9004 capsules ranged from pale blue/violet to dark blue. FIG. 5 charts the SAE defined white region 50, and data points 60 from lamp samples dipped at different concentrations, or fired differently, according to this specification. While the darkest blue samples fall on the edge of the SAE white region 50, a range of bluish intensities were obtained that were all within the SAE white region 50. The SAE white region 50 is defined by the CIE color coordinates (0.310, 0.282); (0.310, 0.348); (0.453, 0.440); (0.500, 0.440); (0.500, 0.380) and (0.440, 0.380)).

Figure 6:
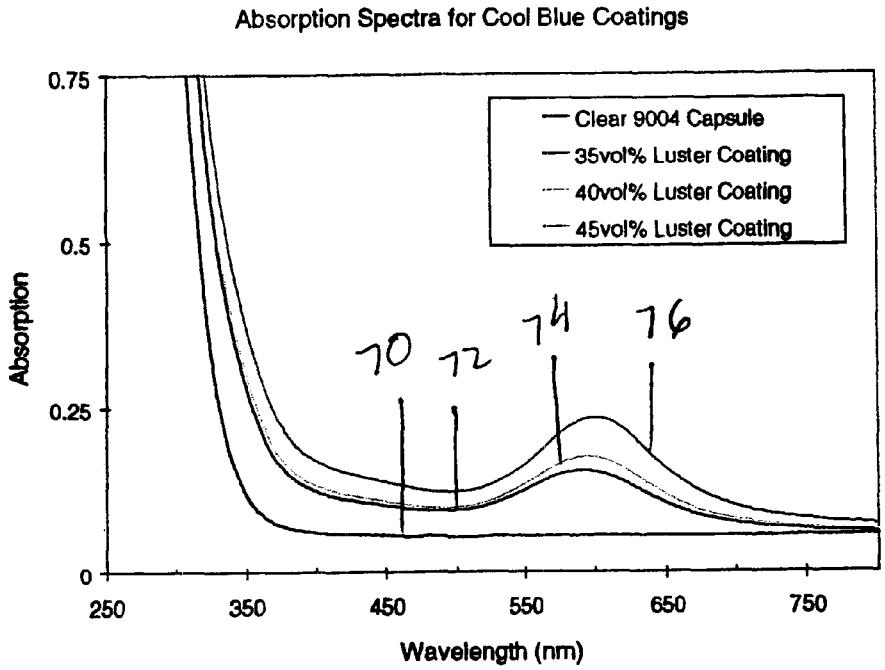
FIG. 6 charts the absorption spectra for various blue coatings.
Figure 7:
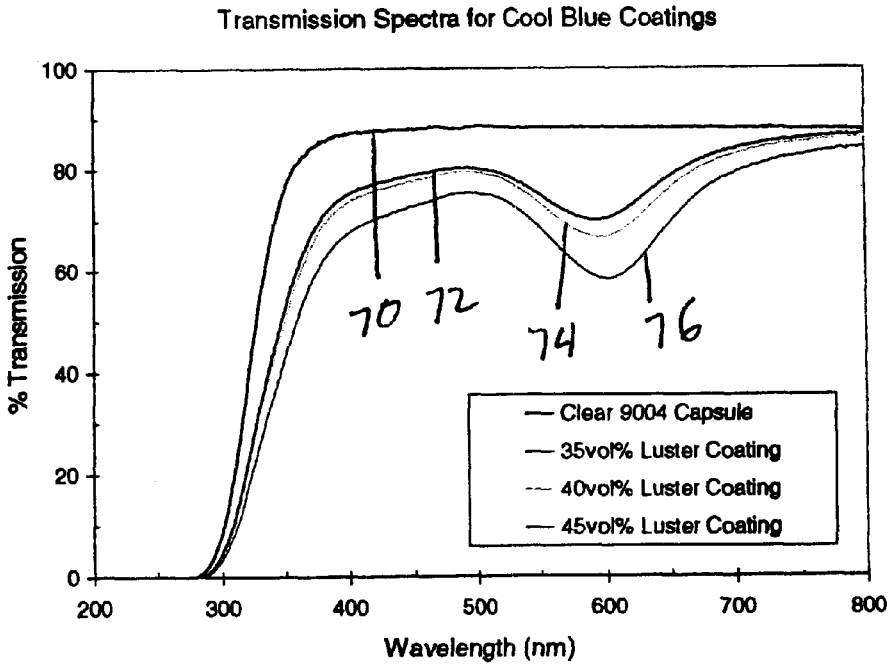
FIG. 7 charts the transmission spectra for various blue coatings.

There are several advantages to using luster coating for producing blue coloration with transmitted light. External luster coatings can be applied directly to sealed lamp capsules and fired to temperatures at or below the glass transition temperature of the glass envelope. The luster coating does not effect the initial (clear) lamp capsule fabrication. The intensity of the blue color may be adjusted by altering the coating solution chemistry, for example by adjusting the percent of solvent, or by changing the dip-coat speed. FIG. 6 charts absorption spectra for various blue coatings. FIG. 7 charts the transmission spectra for various blue coatings. In FIGS. 6 and 7 the line 70 is the result for a clear bulb, line 72 for a 35% luster coat coated bulb, line 74 for a 40% luster coated bulb, and line 76 for a 45% luster coated bulb. The luster coating is suitable for high temperature applications. The transparent luster coating does not significantly increase the level of glare over clear glass sources in automotive applications. The absorption filter effect of the coating also eliminates the unwanted color separation seen with dichroic type coatings. In all cases, the color remained within the SAE specification for white. The lumen output of the absorption coated product also complies with the SAE requirements for the 9004, 9005, and 9006 light sources. Table 1. summarizes the Federal 9004 requirements, the standard product results and the coated product results for comparison.

TABLE 1

| | FMVSS 108 | Standard 9004 | Absorption Coated 9004 |
|---|---|---|---|
| Low Beam | 700 ± 15 percent | 751 | 676 |
| High Beam | 1200 ± 15 percent | 1292 | 1199 |
| | FMVSS 108 | Standard 9005 | Absorption Coated 9005 |
| High Beam | 1700 ± 12 percent | 1679 | 1671 |
| | FMVSS 108 | Standard 9006 | Absorption Coated 9006 |
| Low Beam | 1000 ± 15 percent | 1052 | 965 |

Legal beam patterns were produced in all of the headlamp systems tested, and implying there was no significant increase in glare light or reduction in hot-spot beam candela. The resulting beam patterns were found to be DOT compliant in all respects. The disclosed dimensions, configurations and embodiments are as examples only, and other suitable configurations and relations may be used to implement the invention.

The blue luster coating is durable. After more than 500 hours of normal 14 volt operation, life testing of the blue luster coated 9004 lamp capsules showed the luster coating had not faded, crazed, cracked, or peeled. The aged lamp capsules additionally passed all SAE requirements for humidity, glare, color, lumen maintenance, and vibration when tested in headlamps. The lamp capsules had a color correlation temperature (CCT) of 3400 Kelvin or more. The lamp capsules had an average CIE color coordinates within the SAE white light CIE color region defined by the coordinates (0.310, 0.282); (0.310, 0.348); (0.453, 0.440); (0.500, 0.440); (0.500, 0.380) and (0.440, 0.380)). The lamp capsules were then compliant with currently existing headlamp standards. Only the life of the lamp capsule was reduced due to the inherent need to generate more initial lumens. A recent study comparing night vision in drivers using clear lamps, against similar lamps coated according to this specification has shown a clear improvement in night peripheral vision. Subjects identified more targets, and identified them sooner using the blue tinted lamps.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A blue tinted automobile lamp capsule comprising:

a) a glass envelope;

b) a tungsten halogen light source enclosed in the envelope; and c) a luster forming a thin surface skin on the exterior of the envelope resulting in a blue tint to the emitted light.

2. The lamp capsule in claim 1, wherein the luster includes gold, titanium oxide and bismuth oxide.

3. The lamp capsule in claim 1, wherein the molar ratio of titanium oxide to bismuth oxide is from 1/1 to 1/1.5.

4. The apparatus in claim 1, wherein the molar ratio of titanium oxide to bismuth oxide is about 1/1.

5. The apparatus in claim 2, wherein the gold content is 4 to 8 atomic percent.

6. The lamp capsule in claim 1, wherein the luster has a thickness of 75 to 100 nanometers.

7. The lamp capsule in claim 1, wherein having a normal operating envelope surface temperature from 350 degrees Celsius to 650 degrees Celsius.

8. The lamp capsule in claim 1, wherein the envelope is made of aluminosilicate glass.

9. The lamp capsule in claim 1, wherein the blue tinted luster is transparent.

10. The lamp capsule in claim 1, wherein the blue tinted luster is a substantially featureless coating at 50,000 times magnification.

11. The lamp capsule in claim 1, wherein the lamp capsule provides a color correlated temperature (CCT) of 3400 Kelvin or more.

12. A blue tinted automobile lamp capsule comprising:

a) a glass envelope;

b) a tungsten halogen light source enclosed in the envelope; and c) a coating that includes gold, titanium oxide and bismuth oxide, wherein the molar ratio of titanium oxide to bismuth oxide is about one to one, wherein the gold content is about 4 to 8 atomic percent, the coating forming a thin surface skin on the exterior of the envelope with a thickness of 75 to 100 nanometers that is transparent.

13. A method of forming a durable blue tinted automotive lamp capsule without significant additional glare comprising the steps of:

a) forming a glass envelope b) forming a tungsten halogen light source, with an exterior glass envelope c) coating at least a portion of the formed lamp capsule exterior with a mixture of a gold compound, titanium organometallic and a bismuth organometallic compound and a solvent to form a coating on selected regions of the lamp capsule exterior, c) coating at least a portion of the formed lamp capsule exterior with a mixture of a gold compound, titanium organometallic and a bismuth organometallic compound and a solvent to form a coating on selected regions of the lamp capsule exterior, d) heat fusing the lamp capsule envelope and the coating at sufficient temperature to form a transparent, albeit blue tinted coating of a gold containing bismuth- titanium oxide material on the lamp capsule envelope.

14. The method in claim 13, wherein the coating takes place in a saturated vapor environment to achieve a uniform layer.

15. The method in claim 13, wherein the blue tinted luster has a solvent proportion of from 40 to 60 percent.

16. The method in claim 13, wherein the blue tinted luster is fired at a temperature from 350 degrees Celsius to 675 degrees Celsius.

17. The method in claim 13, wherein the blue tinted luster is fired at a temperature of about 650 degrees Celsius.

18. The method in claim 13, wherein the color of the blue tinted luster is developed by heating to at least 525 degrees Celsius for a period of at least 4.0 minutes.

* * * * *